US008815146B2

(12) United States Patent
Yamamoto et al.

(10) Patent No.: US 8,815,146 B2
(45) Date of Patent: Aug. 26, 2014

(54) ALUMINA FORMING IRON BASE SUPERALLOY

(75) Inventors: Yukinori Yamamoto, Knoxville, TN (US); Govindarajan Muralidharan, Knoxville, TN (US); Michael P. Brady, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 13/440,639

(22) Filed: Apr. 5, 2012

(65) Prior Publication Data

US 2013/0266477 A1 Oct. 10, 2013

(51) Int. Cl.
*C22C 38/50* (2006.01)
*C22C 30/00* (2006.01)

(52) U.S. Cl.
USPC ..... 420/54; 420/584.1

(58) Field of Classification Search
USPC ..... 420/54
See application file for complete search history.

(56) References Cited

U.S. PATENT DOCUMENTS

| | | | | |
|---|---|---|---|---|
| 4,359,350 | A * | 11/1982 | Laidler et al. | 148/608 |
| 7,744,813 | B2 | 6/2010 | Brady et al. | |
| 7,754,144 | B2 | 7/2010 | Brady et al. | |
| 7,754,305 | B2 | 7/2010 | Yamamoto et al. | |
| 2008/0292489 | A1 * | 11/2008 | Yamamoto et al. | 420/38 |

* cited by examiner

*Primary Examiner* — Rebecca Lee
(74) *Attorney, Agent, or Firm* — Novak Druce Connolly Bove + Quigg LLP

(57) ABSTRACT

An austenitic stainless steel alloy, consists essentially of, in weight percent 2.5 to 4 Al; 25 to 35 Ni; 12 to 19 Cr; at least 1, up to 4 total of at least one element selected from the group consisting of Nb and Ta; 0.5 to 3 Ti; less than 0.5 V; 0.1 to 1 of at least on element selected from the group consisting of Zr and Hf; 0.03 to 0.2 C; 0.005 to 0.1 B; and base Fe. The weight percent Fe is greater than the weight percent Ni. The alloy forms an external continuous scale including alumina, and contains coherent precipitates of $\gamma'$-$Ni_3Al$, and a stable essentially single phase FCC austenitic matrix microstructure. The austenitic matrix is essentially delta-ferrite-free and essentially BCC-phase-free.

15 Claims, 10 Drawing Sheets

(A)

(B)

ALUMINA FORMING IRON BASE SUPERALLOY

STATEMENT REGARDING FEDERALLY SPONSORED RESEARCH

This invention was made with government support under contract No. DE-AC05-00OR22725 awarded by the U.S. Department of Energy. The government has certain rights in this invention.

FIELD OF THE INVENTION

This invention relates to stainless steel alloys and particularly to austenitic stainless steel alloys.

BACKGROUND OF THE INVENTION

Common austenitic stainless steels contain a maximum by weight percent of 0.15% carbon, a minimum of 16% chromium and sufficient nickel and/or manganese to retain a face centered-cubic (FCC) austenitic crystal structure at cryogenic temperatures through the melting point of the alloy. Austenitic stainless steels are nonmagnetic non-heat-treatable steels that are usually annealed and cold worked. Common austenitic stainless steels are widely used in power generating applications; however, they are becoming increasingly less desirable as the industry moves toward higher thermal efficiencies. Higher operating temperatures in power generation result in reduced emissions and increased efficiencies. Conventional austenitic stainless steels currently offer good creep strength and environmental resistance up to 600-700° C. However, in order to meet emission and efficiency goals of the next generation of power plants structural alloys will be needed to increase operating temperatures by 50-100° C.

Austenitic stainless steels for high temperature use rely on $Cr_2O_3$ scales for oxidation protection. These scales grow relatively quickly, and do not function well in environments containing species like water. High nickel austenitic stainless steels and nickel based superalloys can meet the required property targets, but their costs for construction of power plants are prohibitive due to the high cost of nickel. Creep failure of common austenitic stainless steels such as types 316, 321, and 347 has limited the use of these.

A new class of austenitic stainless steels has been recently developed to be more oxidation resistant at higher temperature—these are the alumina-forming austenitic (AFA) stainless steels. These alloys are described in Yamamoto et al. U.S. Pat. No. 7,754,305, Brady et al U.S. Pat. No. 7,744,813, and Brady et al U.S. Pat. No. 7,754,144, the disclosures of which are hereby incorporated fully by reference.

SUMMARY OF THE INVENTION

An austenitic stainless steel alloy, consists essentially of, in weight percent 2.5 to 4 Al; 25 to 35 Ni; 12 to 19 Cr; at least 1, up to 4 total of at least one element selected from the group consisting of Nb and Ta; 0.5 to 3 Ti; less than 0.5 V; 0.1 to 1 of at least one element selected from the group consisting of Zr and Hf; 0.03 to 0.2 C; 0.005 to 0.1 B; and base Fe, wherein the weight percent Fe is greater than the weight percent Ni, wherein the alloy forms an external continuous scale comprising alumina, and contains coherent precipitates of γ'-$Ni_3Al$, and a stable essentially single phase FCC austenitic matrix microstructure, the austenitic matrix being essentially delta-ferrite-free and essentially BCC-phase-free.

The Al can be between 3 to 3.5. The Ni can be between 30 to 33. The Cr can be between 14 to 16. The austenitic stainless steel can have at least 2.5, up to 3.5 total of at least one element selected from the group consisting of Nb and Ta. The Ti can be between 1 to 2.5. The V can be <0.3. The austenitic stainless steel alloy can have 0.3 to 0.6 of at least one element selected from the group consisting of Zr and Hf. The C can be between 0.05 to 0.15. The B can be between 0.01 to 0.05. The austenitic stainless steel alloy can have more than 0, up to 1 total of at least one element selected from the group consisting of Mo and W.

An austenitic stainless steel alloy, consists essentially of, in weight percent 2.5 to 4 Al; 25 to 35 Ni; 14 to 19 Cr; at least 2.5, up to 4 total of at least one element selected from the group consisting of Nb and Ta; 1 to 3 Ti; less than 0.5 V; 0.3 to 1 of at least on element selected from the group consisting of Zr and Hf; 0.05 to 0.2 C; 0.005 to 0.1 B; and base Fe, wherein the weight percent Fe is greater than the weight percent Ni, wherein the alloy forms an external continuous scale comprising alumina, and contains coherent precipitates of γ' $Ni_3Al$, and a stable essentially single phase FCC austenitic matrix microstructure, the austenitic matrix being essentially delta-ferrite-free and essentially BCC-phase-free.

An austenitic stainless steel alloy, consists essentially of Al; Ni; Cr; at least one element selected from the group consisting of Nb and Ta; Ti; V; at least one element selected from the group consisting of Zr and Hf; C; B; and base Fe. The weight percent Fe is greater than the weight percent Ni. The alloy forms an external continuous scale comprising alumina, and contains coherent precipitates of γ'-$Ni_3Al$. The alloy has a stable essentially single phase FCC austenitic matrix microstructure. The austenitic matrix is essentially delta-ferrite-free and essentially BCC-phase-free. The alloy has a creep resistance of greater than 200 h creep rupture life at 750° C. and 170 MPa, and has an oxidation resistance where positive specific mass change is less than 0.5 mg/cm$^2$ after 1000 h exposure at 800° C. in air with 10 volume percent $H_2O$.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
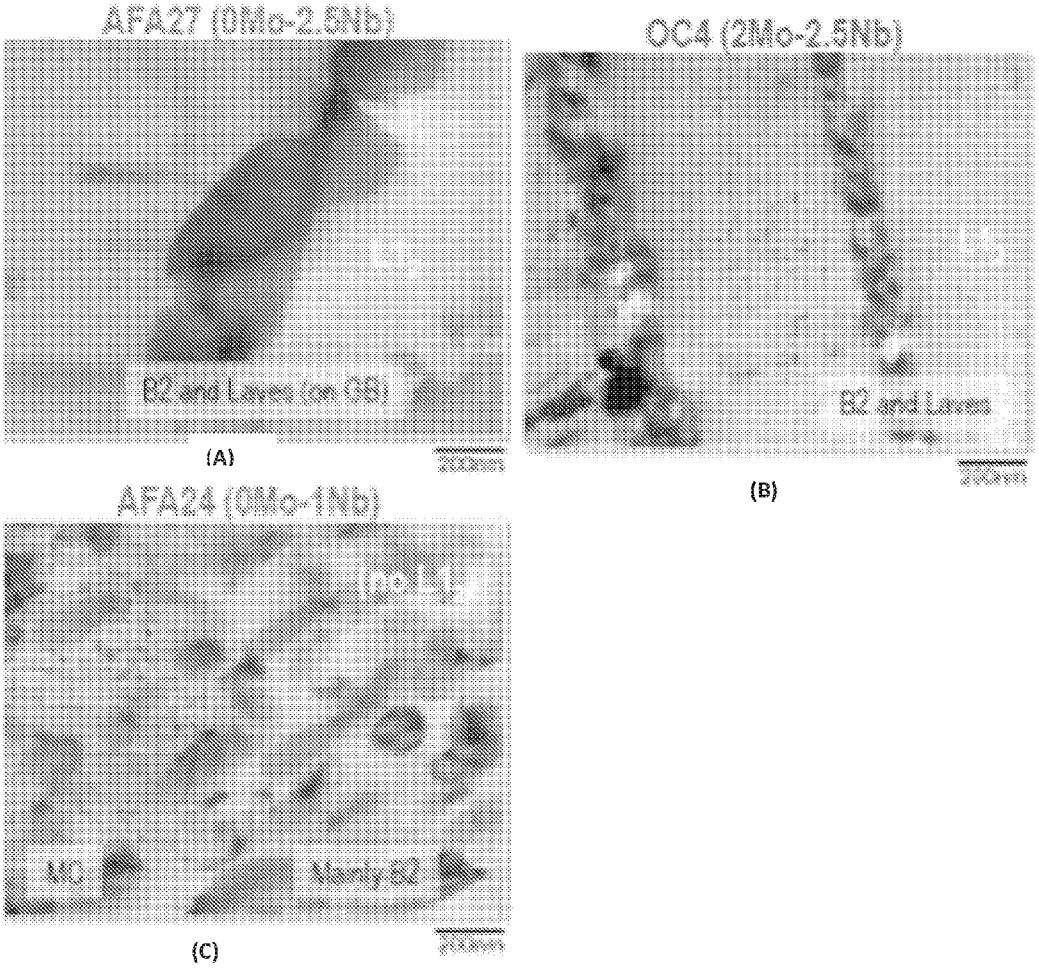
FIG. 1 (A)-(C) are TEM images showing coherent $L1_2$ γ'-$Ni_3Al$ precipitates in 650° C. creep tested AFA alloys.

The invention provides a new class of alumina-forming austenitic (AFA) Fe-based superalloy, which uses γ'-$Ni_3Al$ phase to achieve creep strength. Coherent precipitates of γ'-$Ni_3Al$ and related phases are well established as the basis for strengthening of Ni-base superalloys, which are among the strongest known classes of heat-resistant alloys. The use of γ'-$Ni_3Al$ in AFA offers the potential for greater creep strengthening and the opportunity to precipitate-harden the AFA alloys for improved high-temperature tensile strength.

An austenitic stainless steel alloy, consists essentially of, in weight percent 2.5 to 4 Al; 25 to 35 Ni; 12 to 19 Cr; at least 1, up to 4 total of at least one element selected from the group consisting of Nb and Ta; 0.5 to 3 Ti; less than 0.5 V; 0.1 to 1 of at least one element selected from the group consisting of Zr and Hf; 0.03 to 0.2 C; 0.005 to 0.1 B; and base Fe. The invention can include any combination of maximum and minimum weight percentages within these ranges, for example, Al can be 2,5-3, 3-4, and/or 2.75-3.5, and the weight ranges of the other components can also vary within the identified ranges. The weight percent Fe is greater than the weight percent Ni. The alloy forms an external continuous scale comprising alumina, and contains coherent precipitates of γ'-$Ni_3Al$. The alloy comprises a stable essentially single phase FCC austenitic matrix microstructure, the austenitic matrix being essentially delta-ferrite-free and essentially BCC-phase-free.

The Al can be between 3 to 3.5. The Ni can be between 30 to 33. The Cr can be between 14 to 16. The austenitic stainless steel can have at least 2.5, up to 3.5 total of at least one element selected from the group consisting of Nb and Ta. The Ti can be between 1 to 2.5. The V can be <0.3. The austenitic stainless steel alloy can have 0.3 to 0.6 of at least one element selected from the group consisting of Zr and Hf. The C can be between 0.05 to 0.15. The B can be between 0.01 to 0.05. The austenitic stainless steel alloy can have more than 0, up to 1 total of at least one element selected from the group consisting of Mo and W.

An austenitic stainless steel alloy can consist essentially of, in weight percent 2.5 to 4 Al; 25 to 35 Ni; 14 to 19 Cr; at least 2.5, up to 4 total of at least one element selected from the group consisting of Nb and Ta; 1 to 3 Ti; less than 0.5 V; 0.3 to 1 of at least on element selected from the group consisting of Zr and Hf; 0.05 to 0.2 C; 0.005 to 0.1 B; and base Fe, wherein the weight percent Fe is greater than the weight percent Ni, wherein the alloy forms an external continuous scale comprising alumina, and contains coherent precipitates of γ'-$Ni_3Al$, and a stable essentially single phase FCC austenitic matrix microstructure, the austenitic matrix being essentially delta-ferrite-free and essentially BCC-phase-free.

An austenitic stainless steel alloy can consist essentially of Al; Ni; Cr; at least one element selected from the group consisting of Nb and Ta; Ti; optionally V; at least one element selected from the group consisting of Zr and Hf; C; and base Fe. The weight percent Fe is greater than the weight percent Ni. The alloy forms an external continuous scale comprising alumina, and contains coherent precipitates of γ'-$Ni_3Al$. The alloy has a stable essentially single phase FCC austenitic matrix microstructure. The austenitic matrix is essentially delta-ferrite-free and essentially BOO-phase-free. The alloy has a creep resistance of greater than 200 h creep rupture life at 750° C. and 170 MPa, and has an oxidation resistance where positive specific mass change is less than 0.5 mg/$cm^2$ after 1000 h exposure at 800° C. in air with 10 volume percent $H_2O$.

The alloys of the invention can further include Si. The Si can be between 0 and 1 weight percent. In one aspect, the Si is between 0.15 and 0.5 weight percent.

Metastable γ'-$Ni_3Al$ was unexpectedly observed in some current AFA alloys exposed at 650° C., resulting in temporarily enhanced creep resistance at this temperature (Table 1 and FIG. 1).

TABLE 1

Nominal compositions of select AFA alloys covered under exist ORNL AFA patents

| | Composition (wt %) | | | | | | | | | | | | | | |
|---|---|---|---|---|---|---|---|---|---|---|---|---|---|---|---|
| | Fe | Cr | Mn | Ni | Cu | Al | Si | Nb | V | Ti | Mo | W | C | B | P |
| OC-4 | 49.12 | 14 | 2 | 25 | 0.5 | 3.5 | 0.15 | 2.5 | 0.05 | 0.05 | 2 | 1 | 0.1 | 0.01 | 0.02 |
| AFA27 | 52.12 | 14 | 2 | 25 | 0.5 | 3.5 | 0.15 | 2.5 | 0.05 | 0.05 | 0 | 0 | 0.1 | 0.01 | 0.02 |
| AFA24 | 53.62 | 14 | 2 | 25 | 0.5 | 3.5 | 0.15 | 1 | 0.05 | 0.05 | 0 | 0 | 0.1 | 0.01 | 0.02 |
| OC-5 | 51.12 | 14 | 2 | 25 | 0.5 | 3 | 0.15 | 1 | 0.05 | 0.05 | 2 | 1 | 0.1 | 0.01 | 0.02 |

Figure 2:
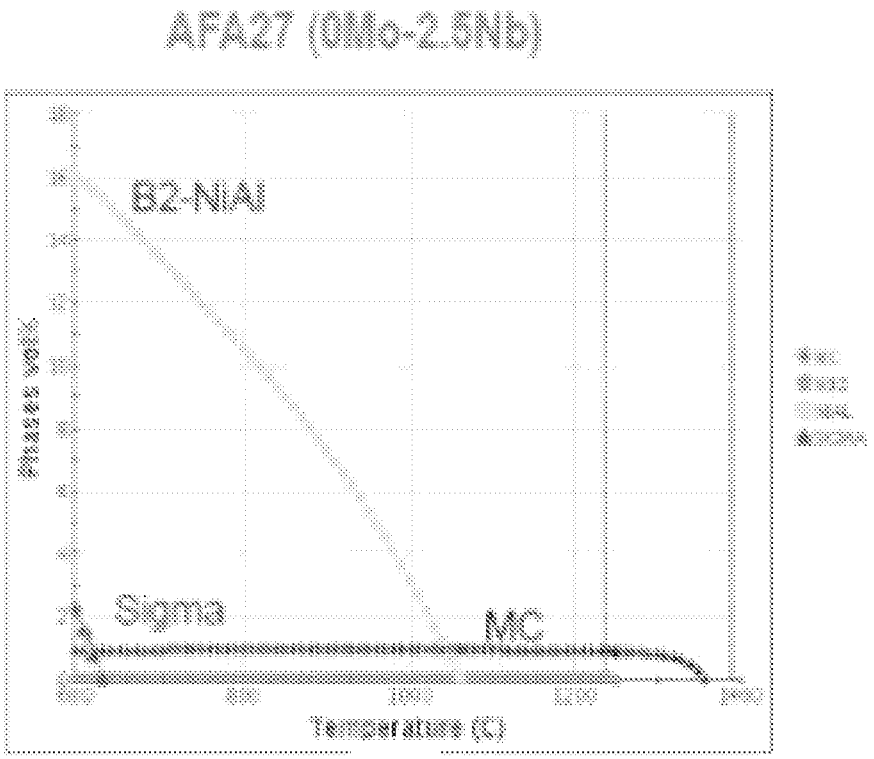
FIG. 2 (A)-(B) are plots illustrating computational thermodynamic calculations showing phases of $L1_2$ γ'-$Ni_3Al$ with temperature.
Figure 2:
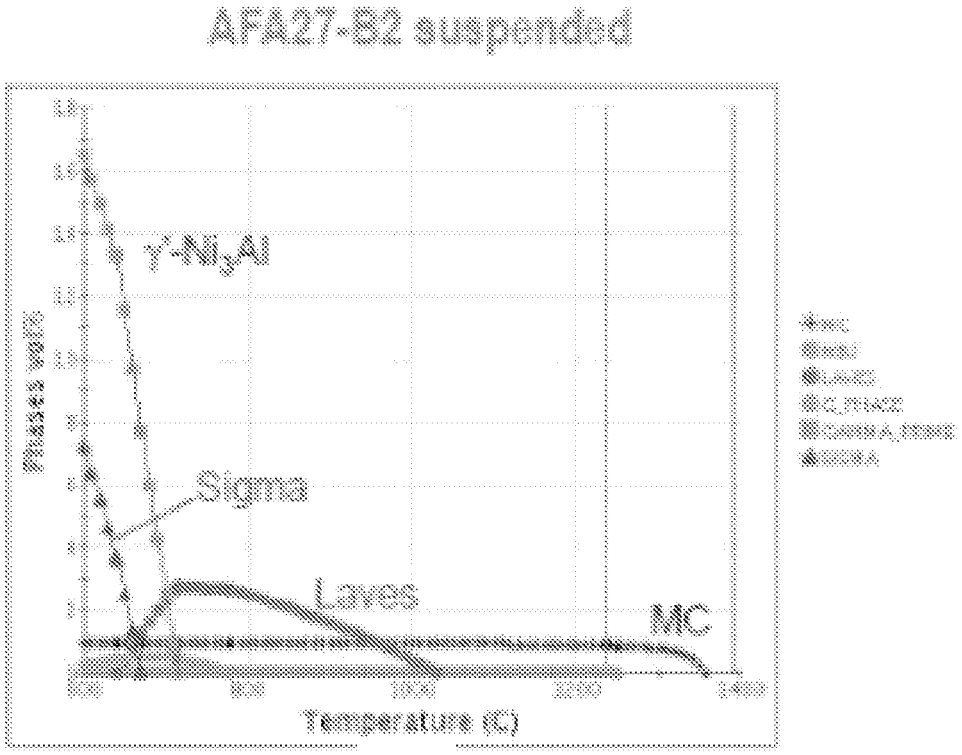

The $L1_2$ γ'-$Ni_3Al$ was found to be favored by increasing levels of Nb additions from 1 to 2.5Nb and/or decreased levels of C (which effectively increased the Nb solution in the austenite matrix). However, the γ'-$Ni_3Al$ converted to B2-NiAl with increased exposure time, which is not an effective precipitate for creep strengthening. Computational thermodynamic calculations confirmed that the γ'-$Ni_3Al$ was not stable in these alloys (FIG. 2). FIG. 2 indicates the γ'-$Ni_3Al$ precipitates are only formed if the B2-NiAl equilibrium phase formation is suspended. The γ'-$Ni_3Al$ phase is not thermodynamically stable in this alloy.

In prior AFA alloy development work using AFA alloys with 20 wt. % Ni and 1 wt. % range Nb, the ability to form a protective alumina scale at a given temperature (the source of oxidation resistance) was found to be compromised by additions of Ti and V. An upper limit of total Ti+V of ≤0.3 wt. % was established to achieve desired alumina scale formation. It has been found that higher levels of Ti and V can be tolerated if higher levels of Cr and Ni are used. Specifically, in alloys with 14 wt. % Cr and ≥25 wt. % Ni, improved tolerance to Ti and V was achieved.

Figure 3:
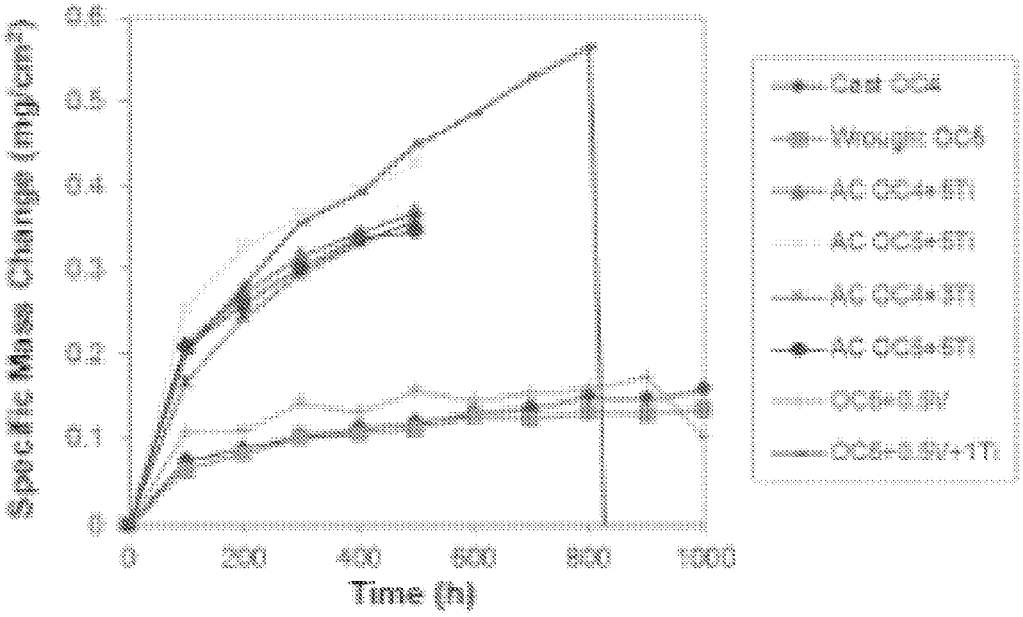
FIG. 3 is a plot of specific mass change with time measuring oxidation at 800° C. in air with 10% $H_2O$.

FIG. 3 shows oxidation data at an aggressive screening condition of 800° C. in air with 10% $H_2O$ for OC-4 and OC-5 compositions modified with 3 wt. % Ti (substituted for Fe), 5 wt. % Ti, 0.5 wt. % V, and 0.5 wt. % V+1 wt. % Ti. Although individual additions of Ti, V did increase oxidation rate, the mass change values after 500 h of exposure at less than 0.5 mg/$cm^2$ suggest a usable degree of oxidation resistance was retained, although oxidation resistance may be lost on longer exposure for some of these compositions. The mixture of Ti and V in the 005+0.5V+1Ti alloy showed a significant loss of oxidation resistance, with a loss of protective alumina formation and a transition to oxide scale spallation after 800 h of exposure. In contrast, the OC-5 baseline alloy and OC-5+0.5V showed good oxidation resistance out to 1000 h of exposure. These findings indicate that at high Cr and Ni levels, substantial amounts of Ti or V may be tolerated, although there still exists a synergistic decrease in oxidation resistance when both Ti and V are present at significant quantities in the alloy. This finding provides a basis to use Ti additions in AFA base alloys, as Ti may also be used to increase stability of the desired $\gamma'$-$Ni_3Al$ strengthening phase.

Based on these findings, the alloys described in Table 2 were manufactured by cast and wrought techniques previously used for AFA alloys and evaluated for creep and oxidation resistance.

TABLE 2

Analyzed compositions of evaluated $\gamma'$-$Ni_3Al$ alloy series

| Name | Fe | Cr | Mn | Ni | Cu | Al | Si | Nb | V | Ti | Mo | W | Y |
|---|---|---|---|---|---|---|---|---|---|---|---|---|---|
| | Nominal Composition (wt %) | | | | | | | | | | | | |
| DAFA 12 | 46.55 | 14 | | 32 | | 4 | 0.15 | 3.3 | | | | | |
| DAFA 13 | 45.85 | 14 | | 32 | | 4 | 0.15 | 3 | | 1 | | | |
| DAFA 14 | 45.55 | 14 | | 32 | | 4 | 0.15 | 3 | | 1 | | | |
| DAFA 15 | 45.45 | 14 | | 32 | | 4 | 0.15 | 3 | | 1 | | | |
| DAFA25 | 44.55 | 14 | | 32 | | 4 | 0.15 | 3 | | 2 | | | |
| DAFA26 | 45.55 | 14 | | 32 | | 3 | 0.15 | 3 | | 2 | | | |
| DAFA27 | 44.55 | 14 | | 32 | | 3 | 0.15 | 3 | | 3 | | | |
| DAFA29 | 45.44 | 14 | | 32 | | 3 | 0.15 | 3 | | 2 | | | |
| | Analyzed Composition (wt %) | | | | | | | | | | | | |
| DAFA 12 | 46.49 | 14.02 | | 32.23 | | 3.93 | 0.14 | 3.17 | <0.01 | <0.01 | | | |
| DAFA 13 | 45.73 | 14.03 | | 32.26 | | 3.96 | 0.14 | 2.88 | | 0.98 | | | |
| DAFA 14 | 45.52 | 13.97 | | 32.27 | | 3.94 | 0.14 | 2.88 | | 0.97 | | | |
| DAFA 15 | 45.38 | 14.03 | | 32.23 | | 3.98 | 0.14 | 2.86 | | 0.97 | | | |
| DAFA25 | 44.32 | 13.97 | <0.01 | 32.45 | | 3.91 | 0.13 | 2.95 | | 1.95 | <0.01 | | |
| DAFA26 | 45.29 | 14 | <0.01 | 32.47 | | 2.95 | 0.13 | 2.93 | | 1.97 | <0.01 | 0.01 | |
| DAFA27 | 44.23 | 14.02 | <0.01 | 32.46 | | 2.98 | 0.14 | 2.96 | 0.02 | 2.88 | <0.01 | | |
| DAFA29 | 45.36 | 13.99 | | 32.46 | | 2.97 | 0.14 | 2.8 | 0.01 | 1.88 | | 0.01 | |

| Name | Zr | Hf | C | B | P | S | O | N |
|---|---|---|---|---|---|---|---|---|
| | Nominal Composition (wt %) | | | | | | | |
| DAFA 12 | | | | | | | | |
| DAFA 13 | | | | | | | | |
| DAFA 14 | 0.3 | | | | | | | |
| DAFA 15 | 0.3 | | 0.1 | | | | | |
| DAFA25 | 0.3 | | | | | | | |
| DAFA26 | 0.3 | | | | | | | |
| DAFA27 | 0.3 | | | | | | | |
| DAFA29 | 0.3 | | 0.1 | 0.01 | | | | |
| | Analyzed Composition (wt %) | | | | | | | |
| DAFA 12 | <0.01 | | 0.004 | <0.0003 | 0.003 | 0.0008 | 0.0014 | 0.0005 |
| DAFA 13 | <0.01 | | 0.004 | 0.0004 | <0.002 | 0.001 | 0.0023 | 0.0003 |
| DAFA 14 | 0.29 | | 0.003 | <0.0003 | <0.002 | 0.0002 | 0.0086 | 0.0008 |
| DAFA 15 | 0.29 | | 0.102 | 0.0004 | <0.002 | <0.0001 | 0.0023 | 0.0007 |
| DAFA25 | 0.3 | <0.01 | 0.005 | 0.0005 | <0.002 | 0.0002 | 0.001 | 0.0006 |
| DAFA26 | 0.29 | <0.01 | 0.002 | <0.0003 | <0.002 | <0.0001 | 0.0012 | 0.0004 |
| DAFA27 | 0.29 | <0.01 | 0.004 | <0.0003 | 0.002 | <0.0001 | 0.0017 | 0.0006 |
| DAFA29 | 0.29 | | 0.065 | 0.005 | <0.002 | 0.0019 | 0.0016 | 0.0033 |

Figure 4:
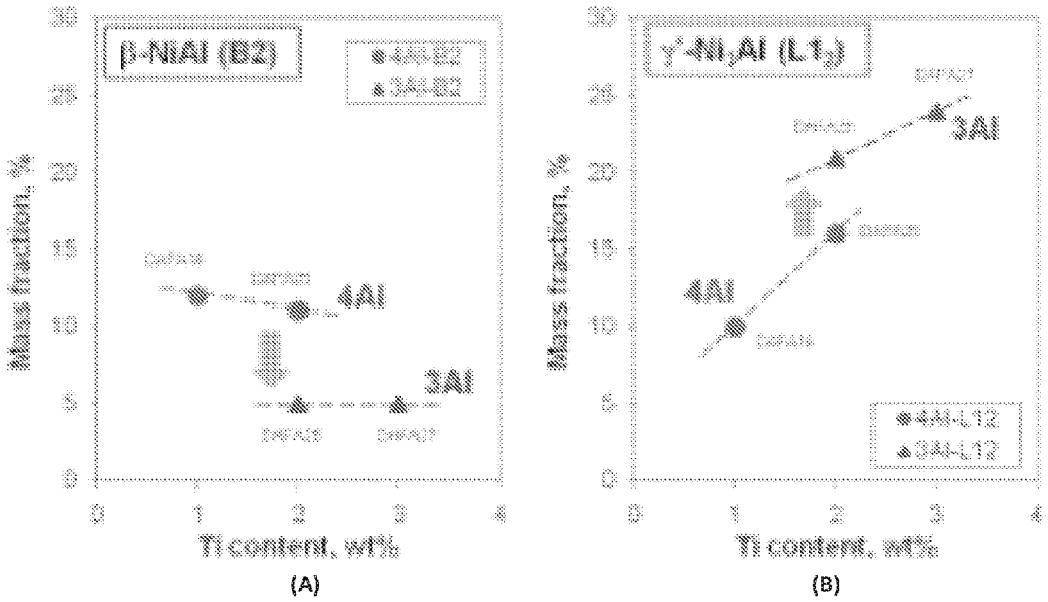
FIG. 4 (A)-(B) are plots of predicted equilibrium volume fractions of B2-NiAl and $L1_2$ γ'-$Ni_3Al$ phases at 750° C.
Figure 5:
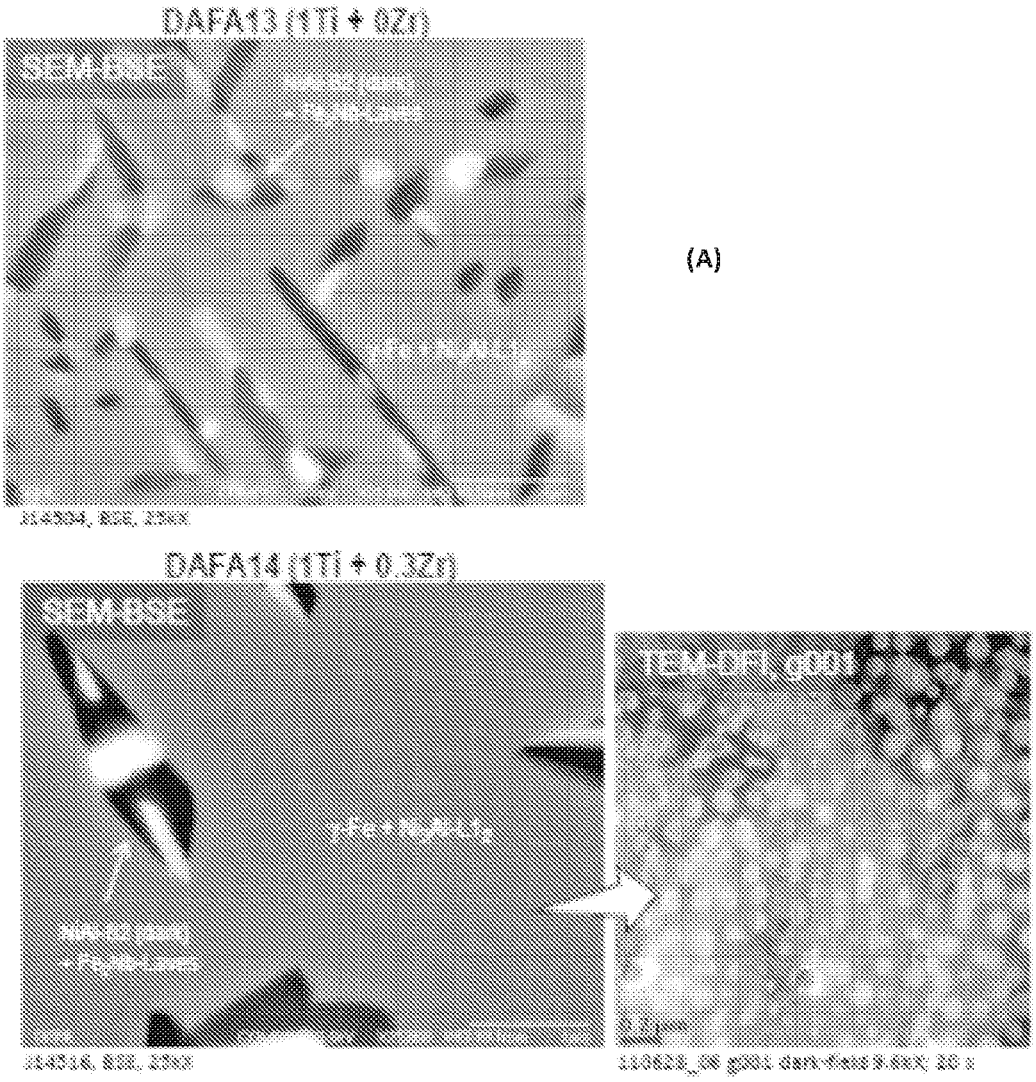
FIG. 5 (A)-(C) are TEM images of alloys DAFA 13 and 14 after ageing for 2000 h at 750° C. showing stable, coherent $L1_2$ γ'-$Ni_3Al$ formation.
Figure 6:
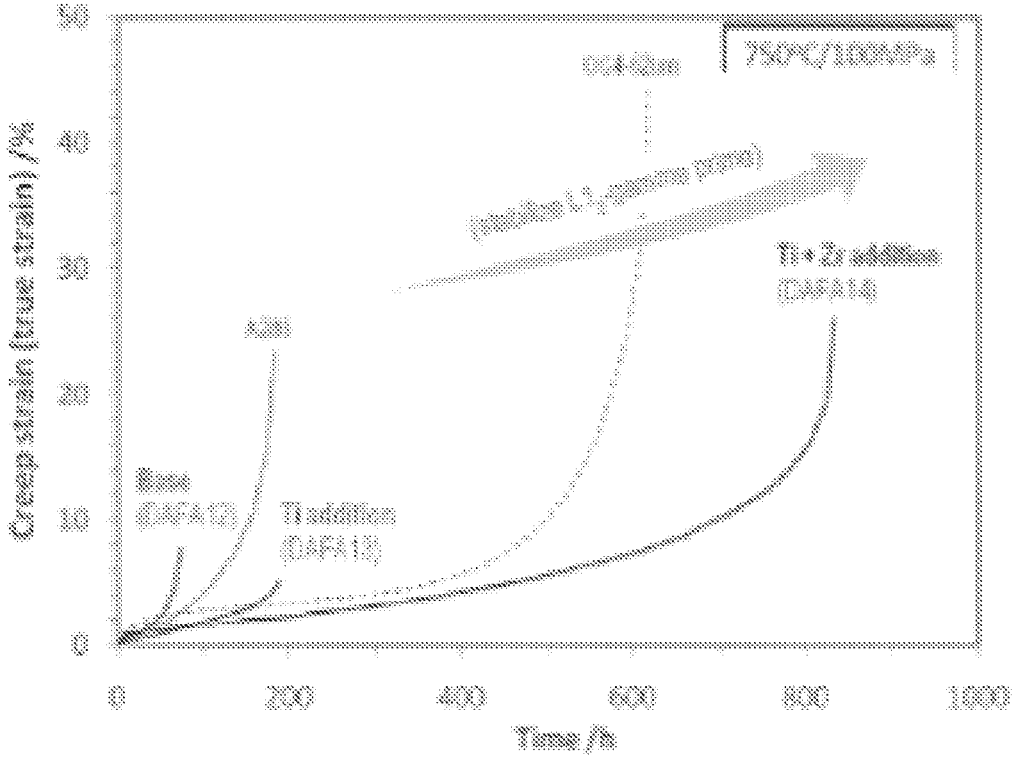
FIG. 6 is a plot of creep data for DAFA 12-14 alloys, the carbide strengthened AFA alloy OC-4, and the commercial Fe-base superalloy A286.
Figure 7:
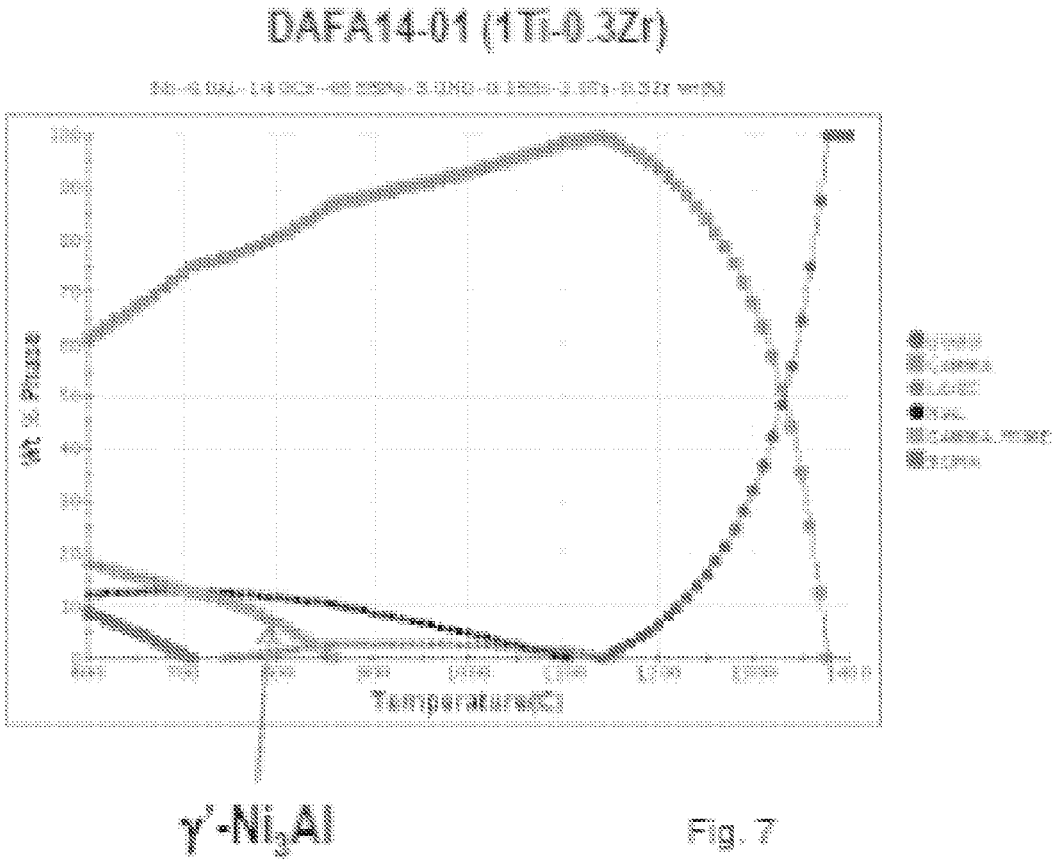
FIG. 7 is a plot of predicted equilibrium volume fractions as a function of temperature.

These alloys were based on high levels of Nb (3 wt. % range), Ni (32 wt. %), and Cr (14 wt. % range) to aide both oxidation and coherent $\gamma'$-$Ni_3Al$ formation (Ni and Nb only). Predicted equilibrium volume fractions of B2-NiAl and $L1_2$ $\gamma'$-$Ni_3Al$ phases at 750° C. are shown in FIGS. 4 (A) and (B). As can be seen, increasing additions of Ti result in equilibrium $L1_2$ $\gamma'$-$Ni_3Al$ phase formation. This was confirmed by TEM analysis of aged alloys DAFA 13 and 14. Further, the addition of 0.3 wt. % Zr in DAFA 14 resulted in a higher volume fraction of $\gamma'$-$Ni_3Al$ (FIG. 5). The addition of Zr along with Ti results in further stabilization and higher volume fraction of $L1_2$ $\gamma'$-$Ni_3Al$. This offers potential for greater creep strengthening (FIG. 6). The addition of Ti and Zr in DAFA 14 results in the best combination of creep resistance at 750° C. and 100 MPa. Although creep data was evaluated at 750° C., the advantages of the coherent $L1_2$ $\gamma'$-$Ni_3Al$ are expected to be even greater at lower creep temperatures as the volume fraction of $\gamma'$-$Ni_3Al$ increases with decreasing temperature (FIG. 7). Although all the creep data shown is for aterial creep tested in the solution treated condition, superalloys are typically aged prior to use, which is expected to result in even greater creep resistance.

Figure 8:
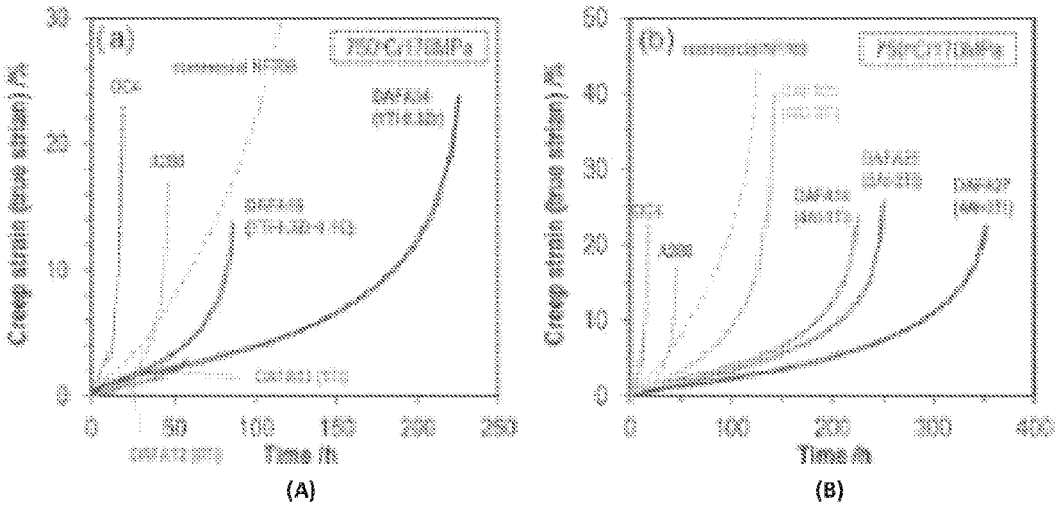
FIG. 8 (A)-(B) is a plot of creep strain data for DAFA 12-15 alloys, DAFA 25-27 alloys, the carbide strengthened AFA alloy OC-4, and the commercial Fe-base superalloy A286 and carbide strengthened austenitic NF709 under highly aggressive screening conditions of 750° C. and 170 MPa.
Figure 9:
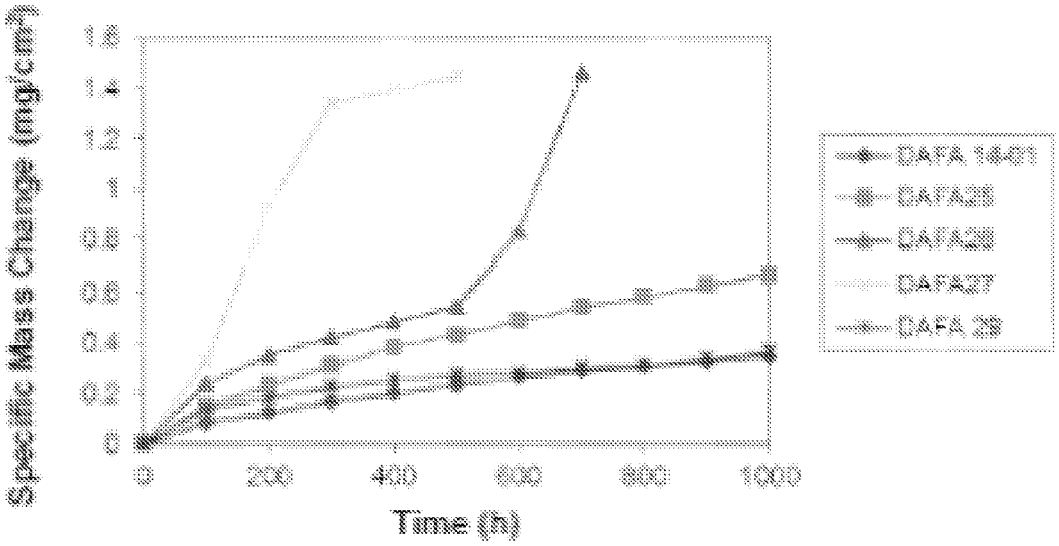
FIG. 9 is a plot of specific mass change with time illustrating oxidation at 800° C. in air with 10% $H_2O$.
Figure 10:
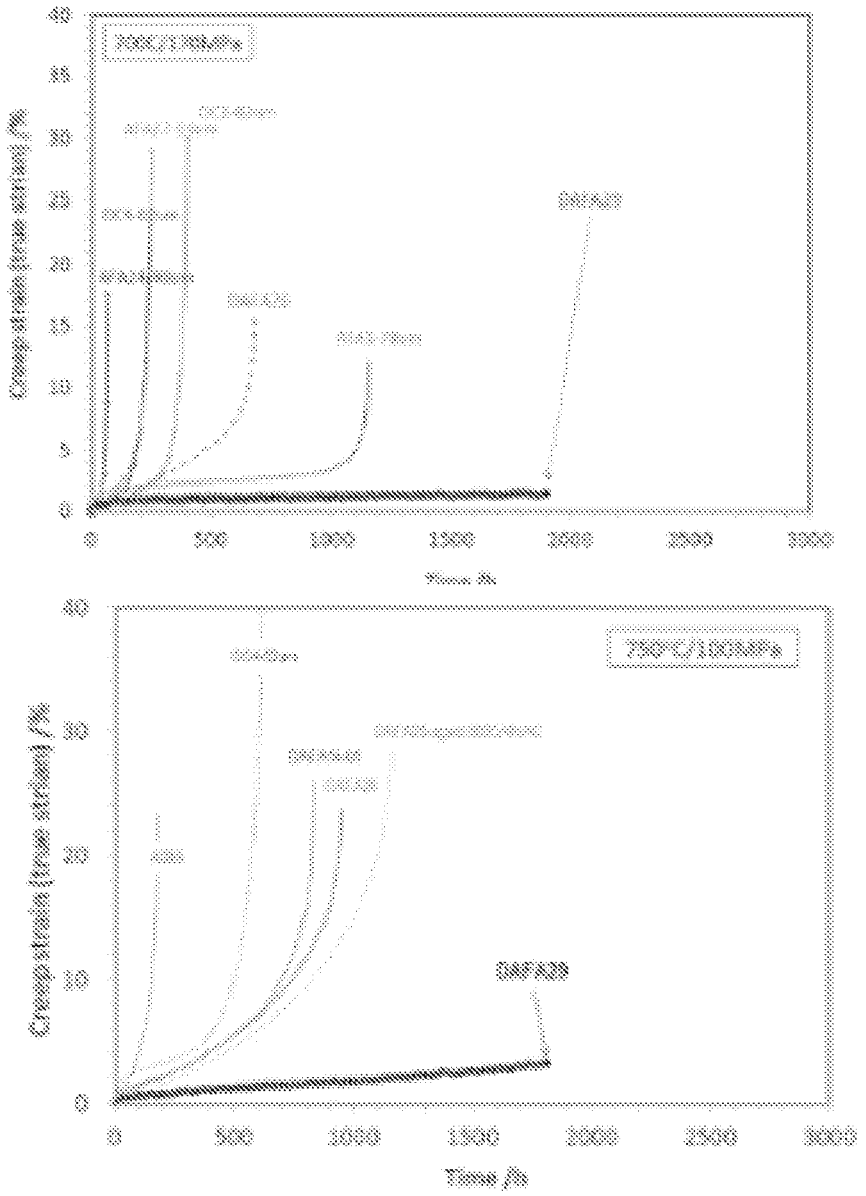
FIG. 10 (A)-(B) are plots of creep strain behavior at 700° C./170 MPa and 750° C./100 MPa.

Based on the good creep resistance of DAFA 14, alloys DAFA 25-27 were selected and manufactured. These DAFA 25-27 alloys are DAFA 14 with higher levels of Ti and/or lower levels of Al to further favor $\gamma'$-$Ni_3Al$ formation (FIG. 4). As shown in FIG. 8, creep resistance was improved over DAFA 14 with lower levels of Al and higher levels of Ti (DAFA 26, 27). Relative to DAFA 14, DAFA 26 and DAFA 27 with lower Al and/or higher Ti additions further increase creep resistance. However, as shown in FIG. 9, although increasing Ti content increases the volume fraction of $L1_2$ $\gamma'$-$Ni_3Al$ (FIG. 4), it decreases oxidation resistance such that alloy DAFA 27 with 3 wt. % Al and Ti transitions to nonprotective oxidation behavior after only 300 h of exposure at 800° C. in air with 10% $H_2O$. Similarly DAFA 26 with 3 wt. % Al and 2 wt. % Ti transitioned to nonprotective oxidation behavior after 500 h of exposure. This finding indicates that, although increased Ti and decreased Al favor $L1_2$ $\gamma'$-$Ni_3Al$, lower Ti and higher Al favor better oxidation resistance. However, as shown in FIG. 9, the addition of small amounts of C (0.065 wt. %) and B (0.005 wt. %) to DAFA 26 to make alloy DAFA 29 (Table 2) resulted in significantly improved oxidation resistance, comparable to that of DAFA 14 despite the lower Al and higher Ti content of DAFA 29. As shown in FIG. 10, the C and B additions in DAFA 29 also significantly improved creep resistance. Therefore, Ni, Cr, Al, and Ti can be balanced along with B and C content in order to tolerate high levels of Ti in order to stabilize $\gamma'$-$Ni_3Al$ for superior creep strength.

The foregoing description of the preferred embodiments of the invention has been presented for purposes of illustration. The invention is not limited to the embodiments disclosed. Modifications and variations to the disclosed embodiments are possible and within the scope of the invention.

We claim:

1. An austenitic stainless steel alloy, consisting essentially of, in weight percent:

2.5 to 4 Al;
25 to 35 Ni;
12 to 19 Cr;
at least 1, up to 4 total of at least one element selected from the group consisting of Nb and Ta;
0.5 to 3 Ti;
less than 0.5 V;
0.1 to 1 of at least one element selected from the group consisting of Zr and Hf;
greater than 0.05, to 0.2 C;
greater than 0.01, to 0.1 B; and
base Fe, wherein the weight percent Fe is greater than the weight percent Ni, wherein said alloy forms an external continuous scale comprising alumina, and contains coherent precipitates of $\gamma'$-$Ni_3Al$, and a stable essentially single phase FCC austenitic matrix microstructure, said austenitic matrix being essentially delta-ferrite-free and essentially BCC-phase-free.

2. The austenitic stainless steel alloy of claim 1, wherein Al is 3 to 3.5.

3. The austenitic stainless steel alloy of claim 1, wherein Ni is 30 to 33.

4. The austenitic stainless steel alloy of claim 1, wherein Cr is 14 to 16.

5. The austenitic stainless steel alloy of claim 1, consisting essentially of at least 2.5, up to 3.5 total of at least one element selected from the group consisting of Nb and Ta.

6. The austenitic stainless steel alloy of claim 1, wherein Ti is 1 to 2.5.

7. The austenitic stainless steel alloy of claim 1, wherein V is <0.3.

8. The austenitic stainless steel alloy of claim 1, consisting essentially of 0.3 to 0.6 of at least on element selected from the group consisting of Zr and Hf.

9. The austenitic stainless steel alloy of claim 1, wherein C is greater than 0.05 to 0.15.

10. The austenitic stainless steel alloy of claim 1, wherein B is greater than 0.01 to 0.05.

11. The austenitic stainless steel alloy of claim 1, consisting essentially of more than 0, up to 1 total of at least one element selected from the group consisting of Mo and W.

12. The austenitic stainless steel alloy of claim 1, consisting essentially of more than 0, up to 1 weight percent of Si.

13. The austenitic stainless steel alloy of claim 1, consisting essentially of 0.15 to 1 weight percent Si.

14. An austenitic stainless steel alloy, consisting essentially of, in weight percent:

2.5 to 4 Al;
25 to 35 Ni;
14 to 19 Cr;
at least 2.5, up to 4 total of at least one element selected from the group consisting of Nb and Ta;
1 to 3 Ti;
less than 0.5 V;
0.3 to 1 of at least one element selected from the group consisting of Zr and Hf;
greater than 0.05, to 0.2 C;
greater than 0.01, to 0.1 B; and
base Fe, wherein the weight percent Fe is greater than the weight percent Ni, wherein said alloy forms an external continuous scale comprising alumina, and contains coherent precipitates of $\gamma'$-$Ni_3Al$, and a stable essentially single phase FCC austenitic matrix microstructure, said austenitic matrix being essentially delta-ferrite-free and essentially BCC-phase-free.

15. An austenitic stainless steel alloy, consisting essentially of Al, Ni, Cr, at least one element selected from the group consisting of Nb and Ta, Ti, V, at least one element selected from the group consisting of Zr and Hf, C, B, and base Fe, wherein the weight percent Fe is greater than the weight percent Ni, wherein said alloy forms an external continuous scale comprising alumina, and contains coherent precipitates of $\gamma'$-$Ni_3Al$, and a stable essentially single phase FCC austenitic matrix microstructure, said austenitic matrix being essentially delta-ferrite-free and essentially BCC-phase-free, the alloy having a creep resistance of greater than 200 h creep rupture life at 750° C. and 170MPa, and having an oxidation resistance where positive specific mass change is less than 0.5 $mg/cm^2$ after 1000 h exposure at 800° C. in air with 10 volume percent $H_2O$.

* * * * *